US010399819B2

(12) United States Patent
Aulanko et al.

(10) Patent No.: US 10,399,819 B2
(45) Date of Patent: Sep. 3, 2019

(54) ELEVATOR ARRANGEMENT

(71) Applicants: Esko Aulanko, Kerava (FI); Matti Räsänen, Hyvinkaa (FI)

(72) Inventors: Esko Aulanko, Kerava (FI); Matti Räsänen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 33 days.

(21) Appl. No.: 14/669,947

(22) Filed: Mar. 26, 2015

(65) Prior Publication Data

US 2015/0197410 A1 Jul. 16, 2015

Related U.S. Application Data

(63) Continuation of application No. PCT/FI2013/051033, filed on Oct. 31, 2013.

(30) Foreign Application Priority Data

Oct. 31, 2012 (FI) ..... 20126138

(51) Int. Cl.

| | |
|---|---|
| ***B66B 1/40*** | (2006.01) |
| ***B66B 7/10*** | (2006.01) |
| ***B66B 9/00*** | (2006.01) |
| ***B66B 11/00*** | (2006.01) |

(52) U.S. Cl.

CPC ..... *B66B 7/10* (2013.01); *B66B 1/40* (2013.01); *B66B 9/00* (2013.01); *B66B 11/009* (2013.01); *B66B 2009/006* (2013.01)

(58) Field of Classification Search

CPC .. B66B 1/40; B66B 7/08; B66B 7/085; B66B 7/10; B66B 9/00; B66B 11/009

See application file for complete search history.

(56) References Cited

U.S. PATENT DOCUMENTS 1,418,089 A * 5/1922 Lindquist ..... B66B 7/10 187/412
3,750,849 A * 8/1973 Berkovitz ..... B66B 1/42 187/256

(Continued)

FOREIGN PATENT DOCUMENTS

CN 1182707 A 5/1998
CN 1628066 A 6/2005

(Continued)

OTHER PUBLICATIONS

Extended European Search Reported dated Jun. 6, 2016 for Application No. EP 13850195.

(Continued)

*Primary Examiner* — Minh Truong

(74) *Attorney, Agent, or Firm* — Harness, Dickey & Pierce, P.L.C.

(57) ABSTRACT

The object of the invention is an elevator arrangement, which comprises at least two elevator cars that are connected to each other with suspension ropes or corresponding and are configured to move simultaneously with each other and reciprocally in an elevator hoistway, and a hoisting machine provided with at least one traction sheave or corresponding. The arrangement comprises at least one compensation means for compensating positioning inaccuracies caused by loading of the elevator cars.

13 Claims, 8 Drawing Sheets

(56) References Cited

U.S. PATENT DOCUMENTS

| | | | | |
|---|---|---|---|---|
| 4,914,780 | A * | 4/1990 | Rogers | E05D 13/123 16/16 |
| 5,101,735 | A * | 4/1992 | Williams | E01B 25/18 104/117 |
| 5,149,922 | A * | 9/1992 | Kondou | B66B 1/3484 187/392 |
| 5,584,364 | A * | 12/1996 | Sakita | B66B 7/06 187/249 |
| 5,750,945 | A | 5/1998 | Fuller et al. | |
| 6,065,569 | A | 5/2000 | Fuller | |
| 6,216,824 | B1 | 4/2001 | Fuller et al. | |
| 6,315,084 | B1 * | 11/2001 | Shon | B66B 7/08 187/292 |
| 6,481,535 | B1 | 11/2002 | Fargo et al. | |
| 6,520,295 | B1 | 2/2003 | Sansevero et al. | |
| 6,854,564 | B2 * | 2/2005 | Reuter | B66B 7/021 187/249 |
| 7,296,662 | B1 | 11/2007 | Fargo | |
| 7,416,056 | B2 * | 8/2008 | Kim | B66B 9/022 187/250 |
| 7,798,290 | B2 * | 9/2010 | Mustalahti | B66B 7/10 187/264 |
| 8,047,335 | B2 * | 11/2011 | Fargo | B66B 7/085 187/411 |
| 9,475,675 | B2 * | 10/2016 | Kawakami | B66B 11/008 |
| 2006/0102434 | A1 * | 5/2006 | Nomura | B66B 11/009 187/266 |
| 2007/0034453 | A1 | 2/2007 | Kim | |
| 2010/0164151 | A1 * | 7/2010 | Zhang | B66B 7/08 267/140.3 |
| 2011/0017552 | A1 * | 1/2011 | Lindberg | B66B 9/00 187/257 |
| 2011/0094831 | A1 | 4/2011 | Jezek | |

FOREIGN PATENT DOCUMENTS

| | | | |
|---|---|---|---|
| CN | 100448768 | C | 1/2009 |
| CN | 101920885 | A | 12/2010 |
| EP | 1574467 | A1 | 9/2005 |
| GB | 913994 | A | 12/1962 |
| GB | 2267078 | A | 11/1993 |
| GB | 2313926 | A | 12/1997 |
| JP | S50-114862 | U | 9/1975 |
| JP | 2004067365 | A | 3/2004 |
| JP | 2005280988 | A | 10/2005 |
| JP | 2010208752 | A | 9/2010 |
| WO | WO-00/30967 | A1 | 6/2000 |

OTHER PUBLICATIONS

International Search Report PCT/ISA/210 for International Application No. PCT/FI2013/051033 dated Feb. 27, 2013.

Written Opinion of the International Searching Authority PCT/ISA/237 for International Application No. PCT/FI2013/051033 dated Feb. 27, 2013.

Finnish Search Report for Application No. 20126138 dated Jul. 2, 2013.

Chinese Office Action dated May 6, 2016 for corresponding CN Application No. 201380057045.6.

SIPO Office Action dated Dec. 20, 2017 for corresponding Chinese Application No. 201380057045.6.

* cited by examiner

ELEVATOR ARRANGEMENT

This application is a continuation of PCT International Application No. PCT/FI2013/051033 which has an International filing date of Oct. 31, 2013, and which claims priority to Finnish patent application number 20126138 filed Oct. 31, 2012, the entire contents of both of which are incorporated herein by reference.

SUMMARY

The object of the invention is an elevator arrangement.

Although the arrangement according to the invention is primarily intended for handling transportation traffic, such as the transportation of passenger traffic, between two floors of a building, said floors being one above the other, e.g. to replace escalators or travelators, transportation traffic between more than two floors can also be handled with the arrangement according to the invention.

Transportation traffic between two floors of a building that are one above another, e.g. the transportation of passengers, is often arranged by means of escalators or travelators, one good aspect of which is good transport capacity. One problem is, however, that escalators, and especially travelators arranged into a ramp, require a very large amount of space in the horizontal direction. In addition, on those floors on which escalators or travelators are used the placement of these devices causes various constraints on the placement of other spaces in the same area or on the arrangement for passageways. Long escalators or travelators, in particular, cause problems in the design of other spaces of the floors, because they prevent internal connections between floors and also the oblique direction of the passenger flow between floors caused by them sometimes compels the starting points for design of the spaces of nearby areas and of the conveying of people to be other than optimal from the viewpoint of the use of the spaces or the conveying of people. Yet another problem with the use of escalators and travelators is that generally at least one elevator is in any case needed in addition to them for physically handicapped people and e.g. for transporting goods, such as children's prams or children's pushchairs and shopping trolleys, between floors.

One common problem in the use of elevator solutions according to prior art, and in solutions using the type of escalators or travelators in which the ends of escalators or travelators that are side-by-side and traveling in different directions are very close, is that passenger flows in different directions meet each other in the passenger embarking and disembarking area. This causes awkward mixing of traffic flows, especially during peak hours.

The aim in the United States patent publications nos. U.S. Pat. No. 6,481,535(B1), U.S. Pat. No. 6,520,295(B1) and U.S. Pat. No. 7,296,662(B1) is to resolve the aforementioned space problems of escalators and travelators, and the problems of passenger flows of different directions colliding, with elevator arrangements in which there is a group of elevator cars traveling between two floors that are one above the other and in which some of the elevators are through-type elevator cars, the doors of one side of which elevator cars are intended for embarking passengers and the doors of the side opposite the aforementioned side are intended for disembarking passengers. In this way it is possible to avoid the meeting in the same elevator of passenger flows in different directions. A problem in these solutions is, however, that when driving two elevator cars with the same machine and with the same suspension ropes, the differences in loading of the elevator cars and the elongations of the suspension ropes resulting from loading affect the sill height of the elevator cars at the floor levels. When an elevator car is loaded its suspension ropes elongate and the elevator car settles e.g. below the sill level of the floor level, which causes a hazard to people and hampers e.g. the loading of wheelchairs and children's pushchairs. Correspondingly, when coming to a floor level, even if e.g. the lighter car were to be driven to be sufficiently flush with the floor level, the sill of the heavier elevator car can remain below the sill level of its own floor level. Likewise, if the heavier car is driven precisely to the floor level, the sill level of the lighter elevator car can remain above the sill level of its own floor level. Too large a height difference between the sills of elevator car and of the floor makes moving difficult and is a safety issue owing to the tripping hazard. When driving a conventional elevator with counterweight, which comprises one elevator car and a counterweight balancing it, there is not normally this type of problem because the elevator car can, by means of its moving machine, drive accurately to the floor and also stay at the floor when the load changes.

The aim of the present invention is to eliminate the aforementioned drawbacks and to achieve an inexpensive and easy-to-implement elevator arrangement, which can replace the use of escalators and travelators, and in which space usage is more advantageous than in the use of escalators and travelators, and correspondingly the transport capacity and control of passenger traffic is better than in normal elevator use. Yet another aim is to achieve an elevator arrangement in which the elevator cars remain sufficiently accurately at their floor levels when they are being loaded and likewise the sill levels of the elevator cars coming both to the upper floor and to the lower floor can be brought accurately to be flush with the sill levels of their own floors regardless of the loading differences of the elevator cars. The elevator arrangement according to the invention is characterized by what is disclosed in the claims.

A preferred way to implement the invention is to connect with suspension ropes or corresponding, e.g. with toothed belts or another type of belts, two elevator cars to each other to move simultaneously with each other and reciprocally in an elevator hoistway. A hoisting machine provided with at least one traction sheave or corresponding moves the elevator cars, said traction sheave preferably being common to the elevator cars. For positioning the elevator cars sufficiently accurately at the floor levels regardless of the loading of the elevator cars and/or for keeping the elevator cars sufficiently well at the floor levels when the load increases or decreases, the solution comprises compensation means, with which positioning inaccuracies are compensated.

In the invention are preferably two elevator cars that are connected to each other with suspension ropes or corresponding and are configured to move simultaneously with each other and reciprocally in an elevator hoistway, and a hoisting machine provided with at least one traction sheave or corresponding, and at least one compensation means for compensating positioning inaccuracies caused by loading of the elevator cars or by loading differences or by loading changes.

A preferred solution for applying the invention is to apply it in an elevator arrangement, in which there is a part of the elevator roping above the elevator cars, e.g. suspension ropes common to two elevator cars, which suspension ropes suspend the elevator cars from above the elevator cars, and in which the elevator cars are moved by means of a part of the elevator roping, e.g. toothed belts or some other traction means, that is below the elevator cars and common to them.

A preferred way to implement the compensation means is a tensioning system that acts on the tension of the elevator roping, in other words on the tension of the parts of the roping suspending the elevator car and of the parts of the roping moving the elevator, e.g. the traction belt or traction belts.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

One advantage, among others, of the solution according to the invention is that by means of it better transport capacity than by means of normal elevator use is achieved and at the same time a space advantage is achieved with respect to conventional escalator use and travelator use. Another advantage is that when loading the elevator cars elongations of the suspension ropes can be compensated in such a way that the sill levels of the elevator cars can easily be kept in the proximity of the sill level of the floor. Likewise, one advantage is that accuracy problems of a run to a sill level resulting from a different loading of the elevator cars can be eliminated and the elevator cars can be brought accurately to the floor levels regardless of their different loading to each other.

One preferred way of implementing the compensation means of the invention is to arrange the part of the elevator roping leaving upwards from the elevator cars to suspend or to support the elevator cars and the second part of the elevator roping, which leaves downwards from the elevator car, to move the elevator cars, and to arrange continuous rope tension in the elevator roping formed from this part of the elevator roping leaving upwards and from this part of the elevator roping leaving downwards, in other words rope tension greater than zero is present all the time everywhere in the elevator roping. In practice a simple way to achieve continuous rope tension is a pretensioning means acting on the elevator roping or a number of pretensioning means acting on the elevator roping.

Thus in a preferred embodiment of the invention the elevator roping is pretensioned, in which case a stiff suspension of the elevator cars is achieved as an advantage. Owing to this type of stiff suspension the movement of the elevator car, e.g. when people move into the elevator car or out of the elevator car, is smaller than if the roping were not pretensioned. Preferably pretensioning brings about tension in the part of the roping downwards from each elevator car, the effect of which in terms of its magnitude as a force pulling the car downwards is at least half the permitted weight of the nominal load of the elevator car. Even more preferably pretensioning brings about tension in the part of the roping downwards from the elevator car, the effect of which in terms of its magnitude as a force pulling the car downwards is the weight of the nominal load permitted for the elevator car or a weight greater than that. A larger force effect can reasonably be 125%-250% of the weight of the nominal load of the elevator car. Dimensioning to be very much larger than this is not sensible, because from the viewpoint of adequate operation of the elevator it is not sensible to overdimension the roping or structures.

In some inventive solutions in which there are parts of the elevator roping upwards and downwards from the elevator car and the elevator roping is pretensioned, the means of the pretensioning system are preferably configured to shorten the elevator roping when the rope tension in the part leaving downwards from the elevator car decreases to below a set magnitude or disappears completely.

In some inventive solutions in which there are parts of the elevator roping upwards and downwards from the elevator car and the elevator roping is pretensioned, the means of the pretensioning system are preferably configured to lengthen the elevator roping when the rope tension in the part leaving downwards from the elevator car increases to above a set magnitude.

Preferably the compensation means for compensating positioning inaccuracies is arranged to act with a controllable or self-operating actuator acting on the position of at least one end of the suspension ropes of the elevator and/or of the ropes moving the elevator or acting on the pretensioning. A self-operated actuator is preferably based on spring force. A suitable actuator for pretensioning, particularly in an arrangement in which the suspension ropes and the moving ropes form a closed loop, or in which there is suspension roping above the elevator cars and roping below the elevator cars that is for moving the elevator cars by means of drive machinery and that is separate from the suspension roping, is such that it produces a constant force. Instead of an actuator producing a constant force, a solution wherein an actuator is at one end or at both ends of the lower roping is also suitable, which actuator maintains the tension of the end of the roping at any given time and tightens the lower roping if the rope tension of the lower roping decreases and possibly also reduces the rope tension if the rope tension grows to be too large, i.e. larger than a pre-set value. Preferably changes in the tension of this type of actuator occur when the elevator car is at a floor for people to leave or to step into the car and during a run of the elevator car the actuator is locked so that the tensioning does not change. Belts, e.g. toothed belts or other corresponding means, can be used instead of suspension ropes and/or instead of moving ropes. An advantageous actuator can also be an actuator moving the floor of an elevator car or an actuator moving the elevator car in the car sling. A hydraulic cylinder, a screw and a spindle motor are, for example, suited for use as active actuators. Preferably a positioning inaccuracy is compensated by means of an actuator or actuator means of the drive machinery moving the elevator cars, said actuator or actuator means being separate from the drive machinery, particularly suitably using as an aid the control of the drive of the drive machinery moving the elevator cars.

The movement of passengers into the elevator cars and out of the elevator cars can easily be controlled by the placement of the doors and by the timing of their opening and closing.

BRIEF DESCRIPTION OF THE DRAWINGS

In the following, the invention will be described in more detail by the aid of some examples of its embodiment with reference to the simplified and diagrammatic drawings attached, wherein.

SUMMARY

Figure 1:
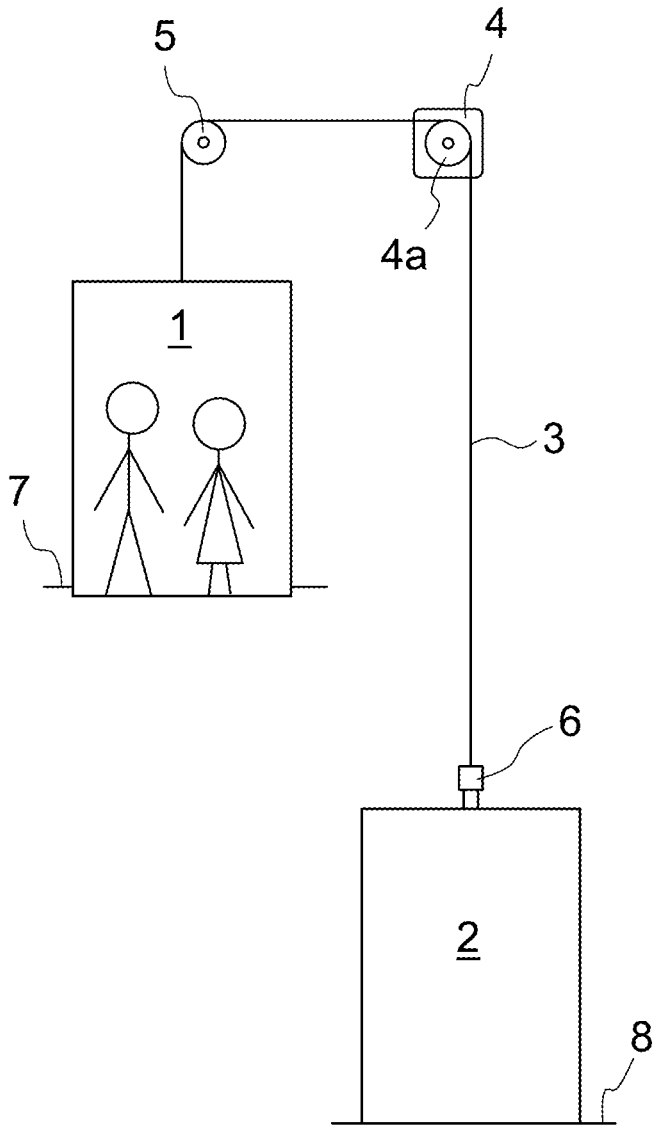
FIG. 1 presents a simplified and diagrammatic side view of one elevator arrangement according to the invention, provided with at least two elevator cars in a 1:1 suspension, wherein the elevator cars are arranged to travel in such a way that when the first elevator car is at the upper floor the second elevator car is at the lower floor and vice versa.

In the solutions according to the invention presented hereinafter the elevator arrangement comprises at least two elevator cars 1 and 2 that move simultaneously with each other and are stationary simultaneously with each other, which elevator cars are arranged to function as counterweights for each other, and which are connected to each other with the suspension ropes 3 of the elevator, of which ropes there can be only one rope or many parallel ropes. The length of the suspension ropes 3 is dimensioned in such a way that when the first elevator car 1 is at the floor 7 that is one floor higher than the lower floor 8, the second elevator car 2 is correspondingly at the level 8 that is one floor lower than the floor 7, and vice versa. In the solutions according to the embodiment the elevator cars 1 and 2 thus travel between only two floors 7 and 8 that are one above the other, but they can also travel between more than two floors one above the other. The elevator cars can serve e.g. a restaurant in the top part of a building, e.g. on the topmost floor, in which case when the first of the two elevator cars 1 connected to each is e.g. at the lower lobby of the building, the second elevator car 2 is at the entrance floor of the restaurant in the top part of the building, and vice versa.

In the elevator arrangement according to the invention there can be a number of side-by-side pairs of elevator cars 1, 2, with one of each pair connected to the other, which pairs can operate on different cycles to each other e.g. in such a way that when some elevator car pair is in position at its own floors 7 and 8, some other elevator car pair is moving between the floor levels 7 and 8. When there are a number of elevator car pairs side-by-side, passengers will quickly, without long waiting times, find an elevator with which to get from one floor to the other.

DETAILED DESCRIPTION

The elevator arrangement according to the invention presented in FIG. 1 and provided with 1:1 suspension comprises at least a first elevator car 1 and a second elevator car 2 configured to move reciprocally in an elevator hoistway, which elevator cars are arranged to function as counterweights for each other, and which are connected to each other with the suspension ropes 3 of the elevator, which ropes also function as hoisting ropes. The first end of the suspension ropes 3 is fixed to the first elevator car 1 and the second end to the second elevator car 2. The elevator cars 1 and 2 are moved in the vertical direction by means of the hoisting machine 4 of the elevator, over the traction sheave 4*a* on which hoisting machine the suspension ropes 3 are led to pass. By means of the diverting pulley 5 the suspension ropes 3 are led to their correct spot on the first elevator car 1.

The loading of the elevator cars 1 and 2 and loads of different magnitudes produce elongations of different magnitudes in the suspension ropes 3, which elongations remain for as long as there are loads in the elevator cars. In this case it might happen such that e.g. even if the lighter first elevator car 1 were to be driven sufficiently precisely to be flush with the upper floor level 7, the sill of the heavier second elevator car 2 can remain above the sill level of its own floor level 8. Correspondingly, if the heavier elevator car 8 is driven precisely to the floor level 8, the sill of the lighter elevator car 1 can remain above the sill level of its own floor level 7. Likewise when loading the elevator cars 1, 2 the suspension ropes elongate and the sill levels of the elevator cars 1, 2 settle below the sill level of their own floor at that time. For eliminating these problems the elevator arrangement according to the invention comprises compensation means 6 for compensating the aforementioned positioning inaccuracies that arise when loading the elevator cars 1 and 2 and when driving to a floor.

The compensation means 6 can be disposed on only one elevator car 1 or 2, e.g. on the second elevator car 2 at the end 3 of the suspension ropes 3 to be fixed to the car, as is presented in FIG. 1. The compensation means 6 can also be connected to the hoisting machine 4 of the elevator to move the hoisting machine 4 for compensating the elongation caused by loading. In the aforementioned solution the compensation means 6 are e.g. arranged to absorb the rope tensions of the suspension ropes 3.

The compensation means 6 can also be inside an elevator car 1 or 2 and act e.g. on the inside floor of the elevator car in such a way that when the sill level of the elevator car remains at a different height with respect to the sill level of the floor level, the compensation means are arranged to displace the inside floor of the elevator car to be flush with the sill level of the floor level.

In the elevator arrangement according to the invention, the compensation of positioning inaccuracies affecting a run to a floor and staying at the floor when loading functions e.g. as follows: Considering now the situation according to FIG. 1, in which people are going into the first elevator car 1 that is at the upper floor level 7, and who want to got the bottom floor 8. The lower elevator car 2 remains e.g. empty. Now the increased load of the first elevator car 1 exerts increased rope tension on the suspension ropes 3 between the traction sheave 4*a* and the elevator car 1. This rope tension tries to elongate the suspension ropes 3, in which case the sill level of the first elevator car tries to settle to below the sill level of the upper floor level 7. In FIG. 1 the settling is exaggerated. In this case the settling that is starting is corrected immediately and actively during the loading with the elevator machine 4, which now functions as a part of the compensation means.

So that the sill level of the second elevator car 2 would not settle as a consequence of the aforementioned corrective action to below the sill level of its own floor level 8, the compensation means 6 are arranged to absorb the movement of the suspension ropes 3 caused by the corrective action made with the elevator machine 4, in which case the second elevator car 2 remains in its position. As a result of the compensation both elevator cars 1 and 2 remain precisely at their own floor levels 7 and 8 during loading. If there were separate compensation means 6 in connection with each elevator car 1, 2, the compensation of the elongation of the suspension ropes 3 resulting from loading could be wholly implemented with the separate compensation means 6 and the elevator machine would not be needed as an aid.

Figure 2:
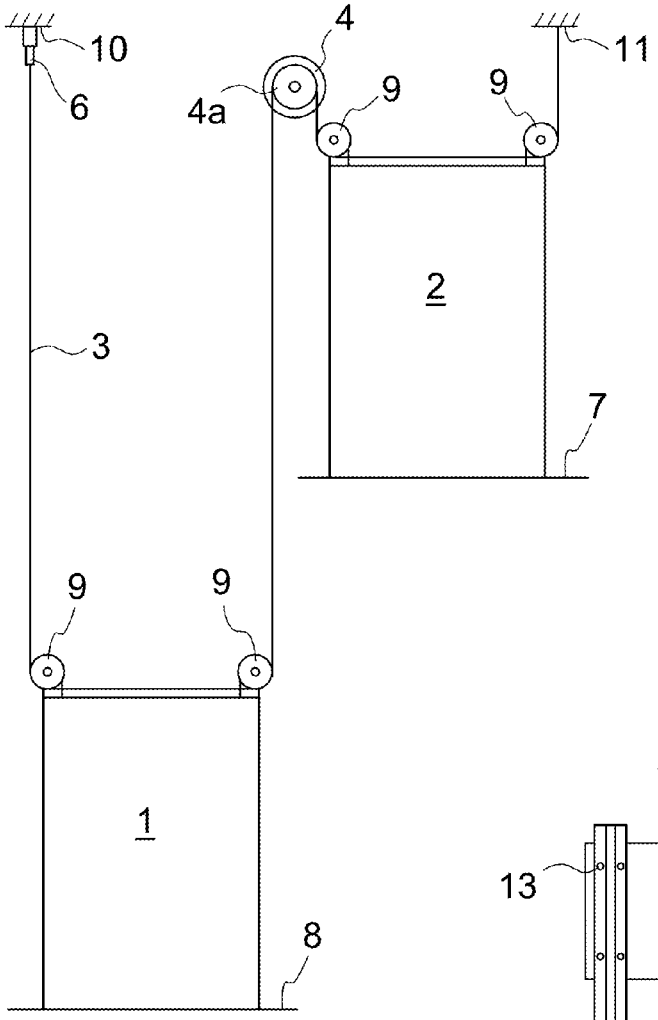
FIG. 2 presents a simplified and diagrammatic side view of one elevator arrangement according to the invention, provided with at least two elevator cars in a 2:1 suspension, wherein the elevator cars are arranged to travel in such a way that when the first elevator car is at the upper floor the second elevator car is at the lower floor and vice versa.

FIG. 2 presents an elevator arrangement, according to the invention, provided with at least two elevator cars 1 and 2 in 2:1 suspension. In the solution according to FIG. 2 on the top part of the elevator cars 1, 2 are diverting pulleys 9, supported by which the elevator cars 1, 2 are suspended. The suspension ropes 3 connecting the elevator cars 1 and 2 and functioning as hoisting ropes are fixed at their first ends e.g. to a rigid fixing point 10 in the top part of the elevator hoistway, led under the diverting pulleys 9 of the first elevator car 1 and onwards over the traction sheave 4*a* of the hoisting machine 4 fixed to the top part of the elevator hoistway, downwards to the diverting pulleys 9 of the second elevator car 2, after passing around the bottom of which diverting pulleys the suspension ropes 3 are led to their rigid fixing point 11 in the top part of the elevator hoistway. In this solution the compensation means 6 are disposed on the first end of the suspension ropes 3 in connection with the fixing point 10.

Figure 3:
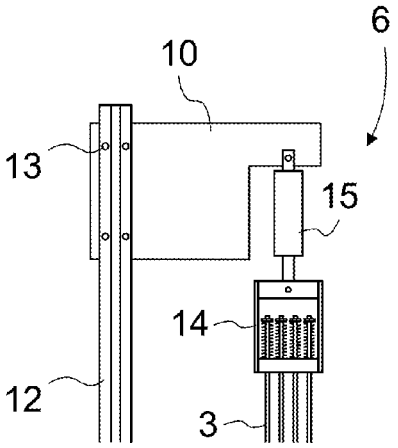
FIG. 3 presents in more detail a simplified and diagrammatic side view of one load equalization arrangement according to the invention.

FIG. 3 presents one compensation means 6, according to the invention, functioning as a load equalization arrangement. In the compensation means 6 an active actuator means 15, such as a hydraulic cylinder, absorbing the tension of the suspension ropes 3 is connected to the suspension ropes 3, which actuator means is fixed at its first end to the collector means 14 of the suspension ropes 3 and at its second end e.g. to the rigid fixing point 10 of the first end of the suspension ropes 3, which fixing point is further fixed e.g. to a guide rail 12 of the elevator car by the aid of fixing means 13. By changing the length of the hydraulic cylinder that is the actuator means 15 the tension of the suspension ropes 3, which is produced by the load of the elevator cars 1 and 2, is absorbed. Instead of a hydraulic cylinder, the actuator means 15 can be a screw means, a spindle motor or some other corresponding actuator means, by changing the length of which the tension of the suspension ropes 3 can be absorbed or the inside floor of the elevator car can be moved.

Figure 4:
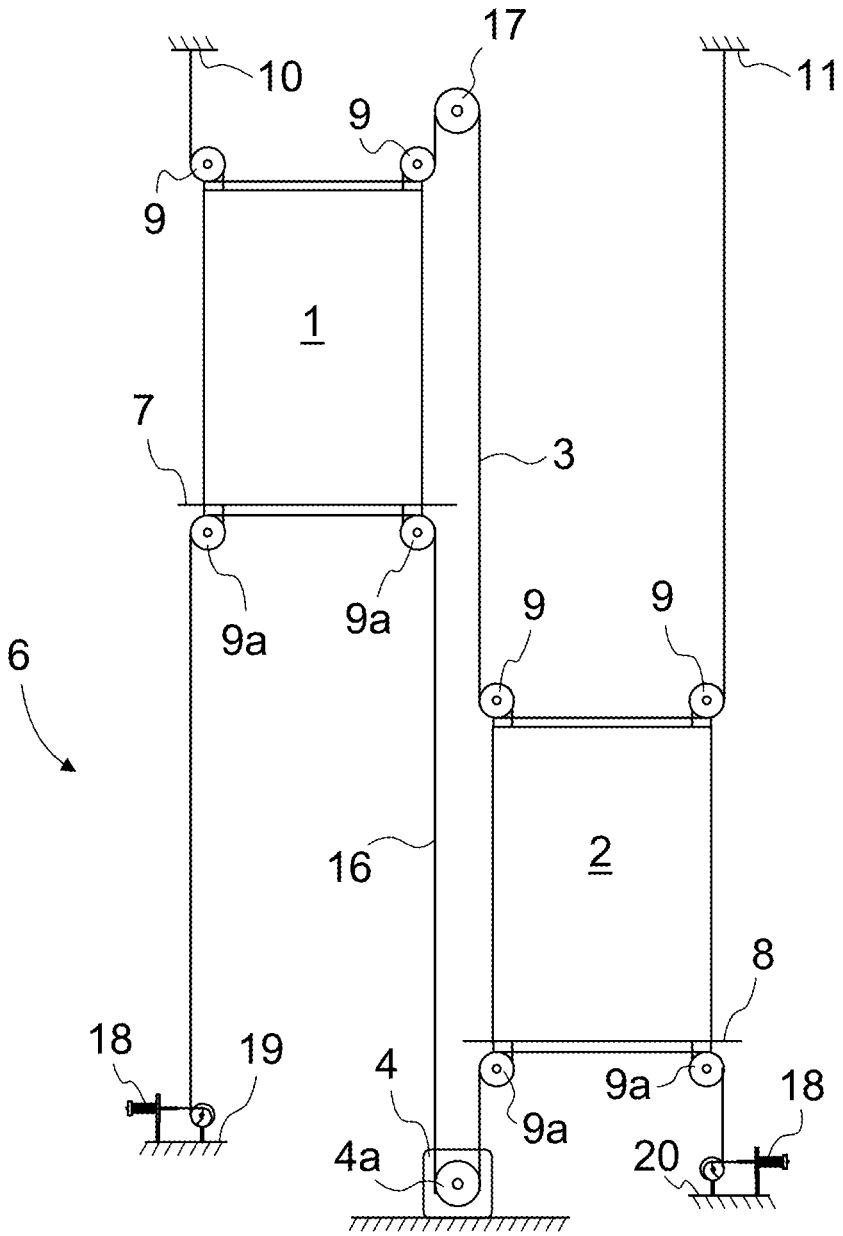
FIG. 4 presents a simplified and diagrammatic side view of a second elevator arrangement according to the invention, provided with at least two elevator cars in a 2:1 suspension, wherein the elevator cars are arranged to travel in such a way that when the first elevator car is at the upper floor the second elevator car is at the lower floor and vice versa.

FIG. 4 presents one elevator arrangement according to the invention, wherein the elevator cars 1 and 2 are suspended with 2:1 suspension, in essentially the same manner as in the solution of FIG. 2. One difference, however, is that in the top part of the elevator hoistway is a conventional diverting pulley arrangement 17, instead of a traction sheave 4*a* of the elevator, and the hoisting machine 4, plus traction sheave, of the elevator is now situated in the bottom part of the elevator hoistway. In this solution the suspension ropes 3 do not function as hoisting ropes, but instead e.g. a toothed belt is the traction means 16 moving the elevator cars 1, 2, which toothed belt is configured to run with a 2:1 suspension under the elevator cars 1, 2. In this case the traction means 16 is fixed at its first end to its rigid fixing point 19 in the bottom part of the elevator hoistway via an active pretensioning means 18 providing a constant tensioning force, led to travel over the diverting pulleys 9*a* on the bottom part of the first elevator car 1 and after that downwards under the traction sheave 4*a* in the bottom part of the elevator hoistway, after passing around which onwards upwards over the diverting pulleys 9*a* on the bottom part of the second elevator car 2 and after that again downwards to its rigid fixing point 20 in the bottom part of the elevator hoistway, to which fixing point the traction means 16 is fixed via a pretensioning means 18. In this way the suspension functions and moving functions of the elevator cars 1, 2 are completely separated from each other.

In the solution according to FIG. 4 a toothed belt, being the traction means 16, functions, together with the active pretensioning means 18 providing a constant tensioning force, as the compensation means 6 reducing and eliminating the aforementioned positioning inaccuracies. Even though the loads in the elevator cars 1 and 2 were of different magnitudes to each other, the traction means 16 and pretensioning means 18 stiffen the suspension & traction system in such a way that the elevator cars 1 and 2 move in full synchronization with each other, in which case both elevator cars stop precisely at the own floor levels 7 and 8 and remain precisely at the own floor levels 7 and 8 during loading and unloading.

Figure 5:
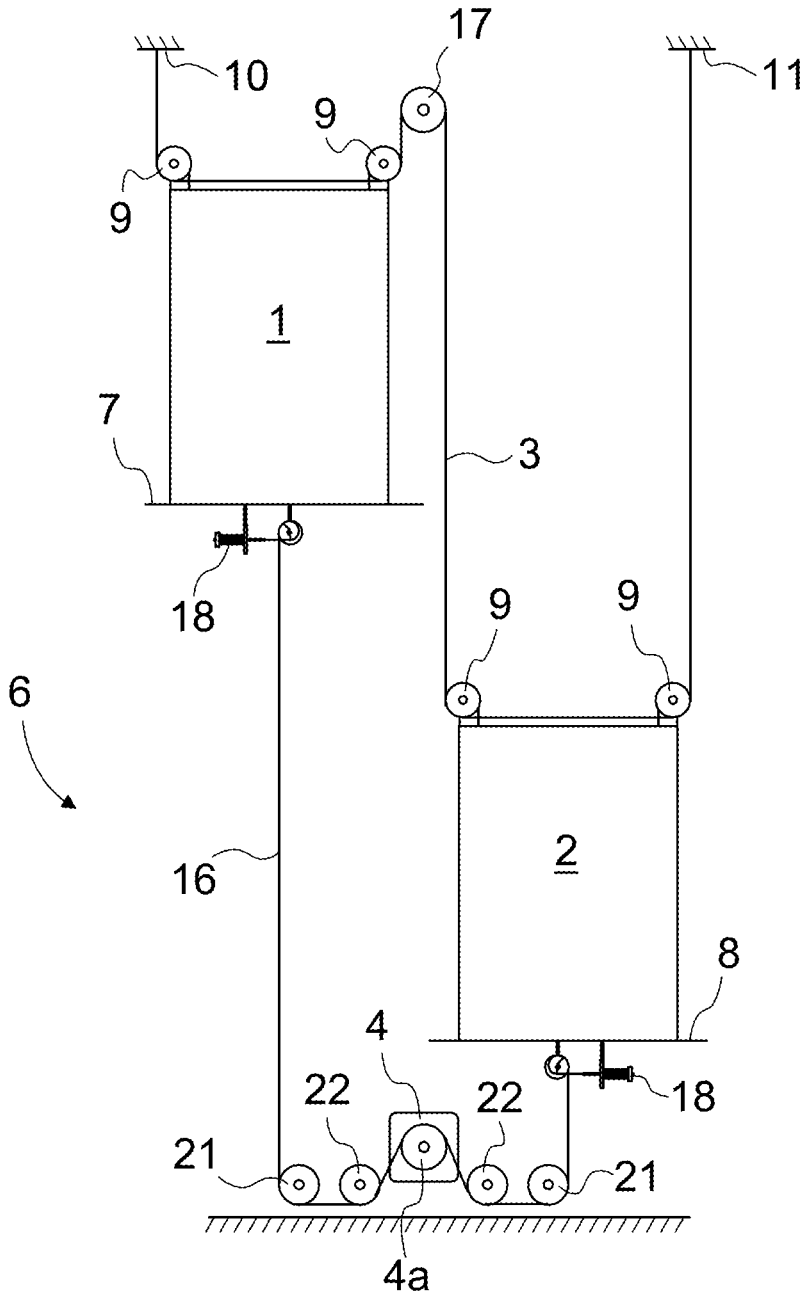
FIG. 5 presents a simplified and diagrammatic side view of a third elevator arrangement according to the invention, provided with at least two elevator cars in a 2:1 suspension, wherein the elevator cars are arranged to travel in such a way that when the first elevator car is at the upper floor the second elevator car is at the lower floor and vice versa.

In the elevator arrangement according to FIG. 5 the suspension arrangement of the elevator cars 1, 2 is essentially similar to what is in the solution according to FIG. 4. On the other hand, the traction arrangement is different and comprises a traction means 16 in a 1:1 suspension ratio. In this case the toothed belt that is the traction means 16 is fixed at its first end to the bottom part of the first elevator car 1 via an active pretensioning means 18 providing a constant tensioning force, led downwards under the diverting pulleys 21 and 22 in the bottom part of the elevator hoistway to pass around the top of the traction sheave 4*a* of the elevator machine 4 in the bottom part of the elevator hoistway and onwards passing around the bottom of the second diverting pulleys 21, 22, led upwards to the bottom part of the second elevator car 2, where the second end of the toothed belt is fixed to the bottom part of the second elevator car 2 via an active pretensioning means 18 providing a constant tensioning force.

The solution according to FIG. 5 functions in essentially the same manner as the solution according to FIG. 4 and the toothed belt that is the traction means 16*b* functions together with the pretensioning means 18, as a compensation means 6.

Figure 6:
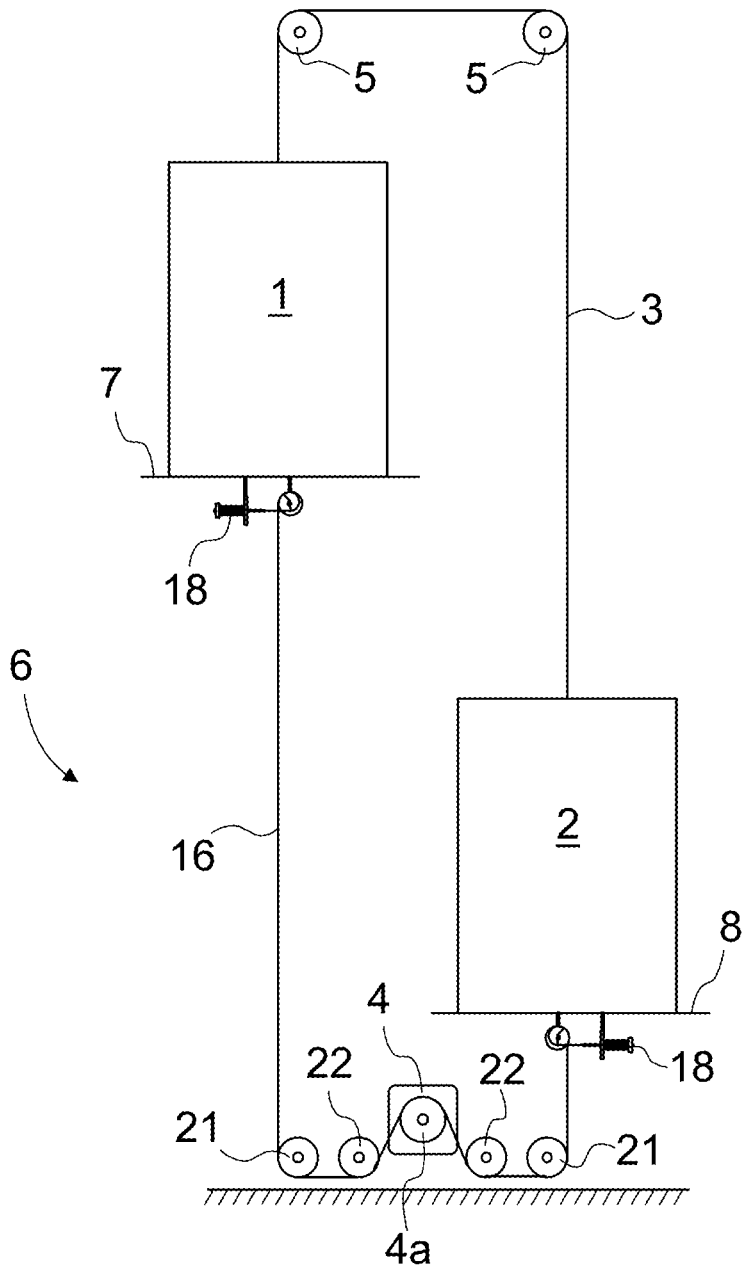
FIG. 6 presents a simplified and diagrammatic side view of yet another elevator arrangement according to the invention, provided with at least two elevator cars in a 1:1 suspension, wherein the elevator cars are arranged to travel in such a way that when the first elevator car is at the upper floor the second elevator car is at the lower floor and vice versa.

In the elevator arrangement according to FIG. 6 the suspension arrangement of the elevator cars 1, 2 is essentially a similar 1:1 suspension to that in the solution according to FIG. 1. Since the suspension ropes 3 do not function as hoisting ropes, the diverting pulley 5 in this solution replaces the traction sheave 4*a* in the top part of the elevator hoistway. Correspondingly, the traction arrangement is similar to the traction arrangement according to FIG. 4, with traction means 16 and with 1:1 roping and also with a traction sheave 4*a* in the bottom part of the elevator hoistway In the elevator arrangement presented in FIGS. 4-6 the traction means 16, plus the active pretensioning means 18 providing a constant tensioning force, functioning as a compensation means 6 is implemented in such a way that the predetermined minimum tension remains all the time in the traction means 16, in which case the whole suspension system is stiff and is not sensitive to changes caused by loading. In this case the pretensioning decreases when loading the elevator cars 1, 2, in which case the pretensioning means 18 and the traction means 16 absorb the reduced pretensioning.

All the compensation means 6 presented above, regardless of their technical solutions and disposal location, are connected to the control system of the elevator for controlling the control system and the compensation means 6 receive information about the position of an elevator car 1, 2 from the control system of the elevator.

Figure 7:
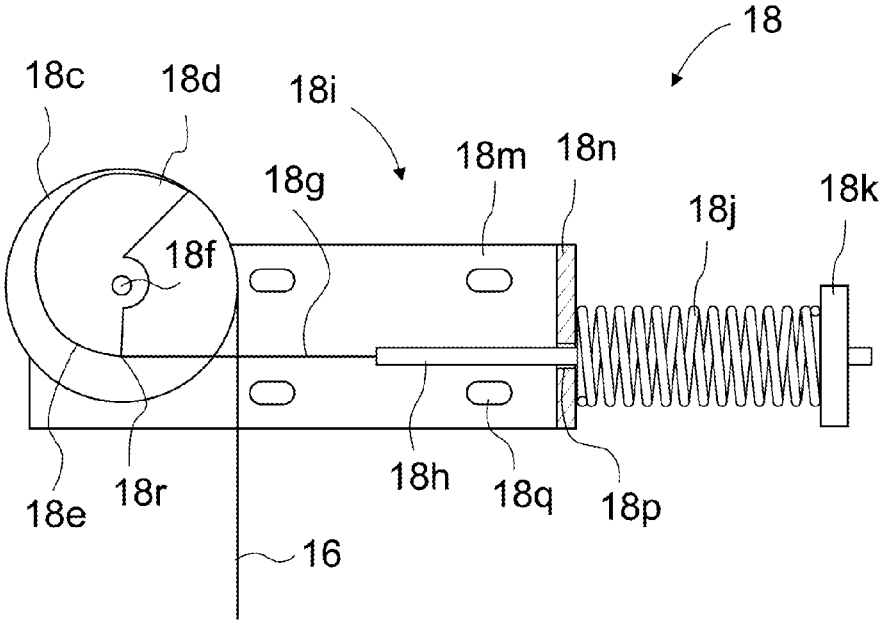
FIG. 7 presents a simplified and diagrammatic side view of one fixing arrangement of a traction means of an elevator according to the invention.
Figure 8:
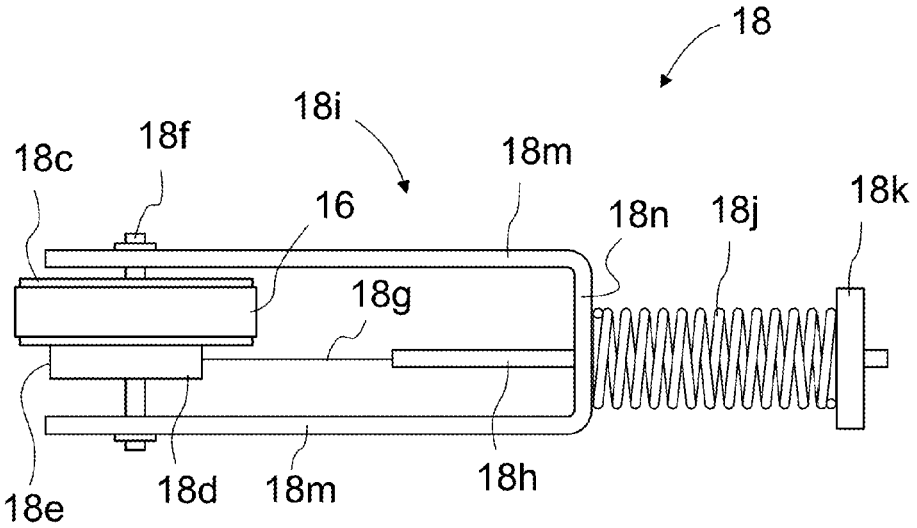
FIG. 8 presents a simplified and diagrammatic top view of the fixing arrangement of a traction means of an elevator according to FIG. 7.

FIGS. 7 and 8 present one active pretensioning means 18, according to the invention, giving constant tensioning force to the traction means 16 of an elevator. The pretensioning means can, however, be structurally different and operate differently to what is described here. The pretensioning means can be fixed at its frame part 18*i* to some rigid fixing point 19, 20 in the elevator hoistway or e.g. to the bottom part of one or of both elevator cars 1, 2, either directly to the elevator car or via the car sling of the elevator. The pretensioning means 18 is configured to enable tensioning that is of as constant a force as possible in the traction means 16.

The pretensioning means 18 comprises at least the aforementioned frame part 18*i*, a roll 18*c* mounted on bearings onto an axle 18*f* so as to rotate freely, an adjustment means 18*d* rotating along with the roll 18*c*, and also a tensioning means 18*g*, the free end of which is tensioned by the aid of a spring 18*j* into its position in the second end of the frame part 18*i*. The frame part 18*i* is e.g. a metal plate bent into a U-shape, as viewed from above, comprising a base part 18*n* and two side flanges 18*m* that are in an orthogonal attitude in relation to it, in at least one of which side flanges are fixing holes 18*q* for fixing the pretensioning means to its mounting base. Correspondingly, the base part 18*n* at the second end of the frame part 18*i* has a hole 18*p* for the rod 18*h* at the free end of the tensioning means 18*g*, through which hole 18*p* the rod 18*h* can be threaded. In addition, there is a hole in the first end, i.e. the free end, of the side flanges 18*m* for the axle 18*f* of the roll 18*c*.

Both ends of the traction means 16, such as of a toothed belt, of the elevator are fixed to the outer rim of the roll 18*c* in such a way that the end of the traction means 16 fixed to the roll 18*c* of the traction means 16 can be coiled for some distance onto the roll 18*c* when the roll 18*c* rotates around its axle 18*f* as the traction means 16 loosen e.g. in connection with loading.

An adjustment means 18*d* rotating along with the roll 18*c*, and having an essentially e.g. spiral outer surface 18*e* that is eccentric with respect to the axis of rotation 18*f*, is fixed to the side of the roll in connection with the roll 18*c*, the length of which eccentric outer surface 18*e*, e.g. in the arrangement according to the embodiment, comprises less than one revolution, i.e. the length of the spiral outer surface 18*e* is smaller than 360°. A tensioning means 18*g*, such as a steel rope or plastic rope or corresponding, is fitted for rotating the eccentric outer surface 18*e* of the adjustment means 18*d*, which tensioning means is fixed at its first end to move along with the roll 18*c* and the adjustment means 18*d*, and at its second end to a tensioning arrangement provided with a rod 18*h* through the base part 18*n* of the frame part 18*i*, with a flange 18*k* and also with a compression spring 18*j*, in which tensioning arrangement the compression spring 18*j* is arranged to press against the outer surface of the base part 18*n* of the frame part 18*i* in such a way that the tensioning arrangement pulls the tensioning means 18*g* by the aid of the spring force of the spring 18*j* and keeps the tensioning means 18*g* always as taut as possible by the aid of its spring force.

What is essential to pretensioning means 18 is that the eccentricity, i.e. the spiral pitch, of the outer rim 18*e* of the adjustment means 18*d* is selected in such a way that it corresponds to the spring constant of the spring 18*j*, in which case in all the rotational positions of the adjustment means 18*d* the tensioning of the traction means 16 remains essentially the same and corresponding to the spring constant. When the traction means 16 stretches or otherwise loosens, the spring 18*j* pulls the tensioning means 18*g* and via it rotates the roll 18*c* and the adjustment means 18*d* in such a way that the distance of the outer rim 18*e* of the adjustment means 18*d* from the axle 18*f* at the point of detachment 18*r* of the tensioning means 18*g* increases according to the eccentricity of the outer rim 18*e*. The eccentricity, i.e. the spiral pitch, of the outer rim 18*e* of the adjustment means 18*d* can also be selected in such a way that the adjustment means 18*d* can compensate in the aforementioned manner a spring other than a compression spring 18*j*, e.g. a gas spring, a draw-spring or some other means providing a spring force.

Figure 9:
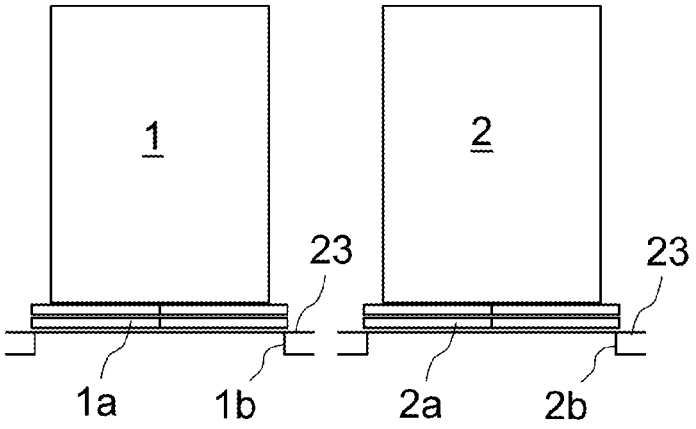
FIG. 9 presents a simplified and diagrammatic top view of two elevator cars one beside the other, wherein the door openings are on the same side of the elevator cars as each other.

FIG. 9 presents a simplified and diagrammatic top view of two elevator cars 1 and 2 one beside the other, which as viewed from above are in essentially the same position. The elevator cars 1 and 2 can be in the same elevator hoistway as each other or each in its own elevator hoistway, the front wall, i.e. the first wall, of which elevator hoistways is marked with the reference number 23. In the front wall 23 are the door openings 1*b* and 2*b*, at the point of which door openings are the hoistway doors 1*a* and 2*a* of the elevator cars. In this case passage into the elevator cars 1 and 2 and out of them is in both elevator cars 1 and 2 in the same direction as each other. For the sake of clarity, the guide rails, diverting pulleys, elevator machine or other hoistway devices are not presented in FIG. 9. The location of the elevator machine 4 can vary and can be e.g. between or behind the elevator cars 1 and 2.

Figure 10:
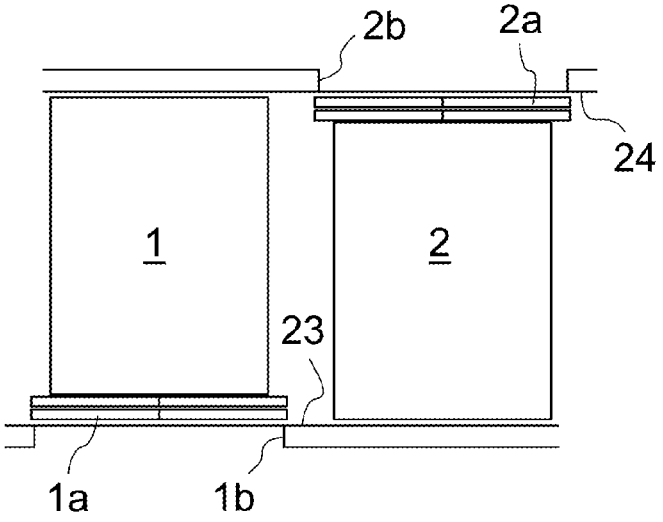
FIG. 10 presents a simplified and diagrammatic top view of two elevator cars one beside the other, wherein the door openings are on the opposite sides of the elevator cars to each other.

FIG. 10 presents a simplified and diagrammatic top view of two elevator cars 1 and 2 one beside the other, which as viewed from above have been turned essentially 180° with respect to each other. In this case also the elevator cars 1 and 2 can be in the same elevator hoistway as each other or each in its own elevator hoistway, the first wall of which elevator hoistways is marked with the reference number 23 and the second, the wall on the opposite side of the elevator hoistway, with the reference number 24. In the first wall 23 on both floor levels 7, 8 is a door opening 1*b*, the hoistway doors 1*a* of the first elevator car 1 being at the point of which door opening. Correspondingly, in the second wall 24 on both floor levels 7, 8 is a door opening 2*b*, the hoistway doors 2*a* of the second elevator car 2 being at the point of which door opening. In this case passage into the elevator cars 1 and 2 and out of them is in both elevator cars 1 and 2 in opposite directions to each other and on different sides of the elevator hoistway. This solution enables extremely good separation of crisscross passenger flows.

Figure 11:
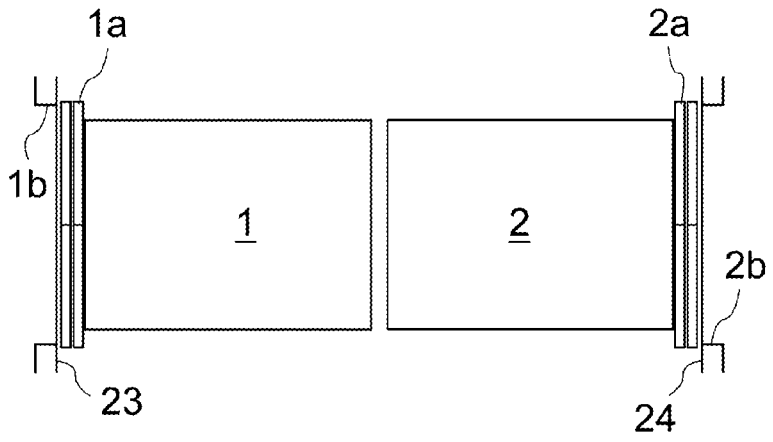
FIG. 11 presents a simplified and diagrammatic top view of two elevator cars in the same elevator hoistway, the rear walls of which elevator cars are facing each other and the door walls face opposite directions to each other.

FIG. 11 presents a simplified and diagrammatic top view of two elevator cars 1 and 2, the rear walls of which elevator cars are facing each other and the door walls are in opposite directions to each other. Also in this case the elevator cars 1 and 2 can be in the same elevator hoistway as each other or each in its own elevator hoistway, the first wall of which elevator hoistways is marked with the reference number 23 and the second, the wall on the opposite side of the elevator hoistway, with the reference number 24. This solution also enables extremely good separation of crisscross passenger flows.

Figure 12:
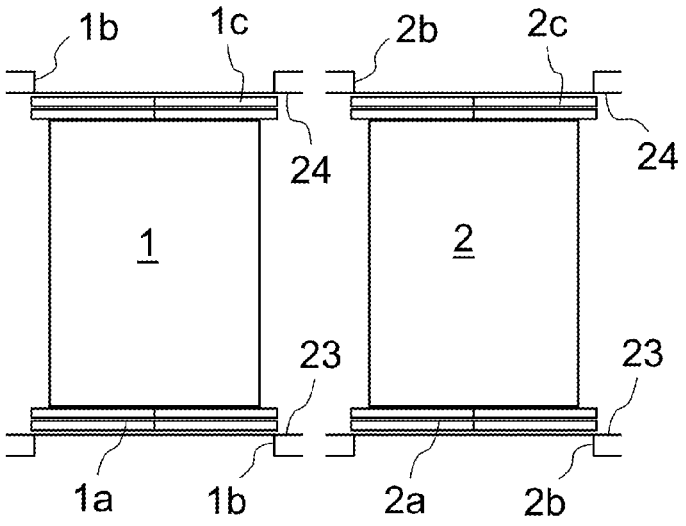
FIG. 12 presents a simplified and diagrammatic top view of two through-type elevator cars one beside the other, in both of which the door openings are on the opposite sides of the elevator cars to each other.

FIG. 12 presents a simplified and diagrammatic top view of two through-type elevator cars 1 and 2 one beside the other, in each of which the door openings are on the opposite sides of the elevator cars to each other. Also in this case the elevator cars 1 and 2 can be in the same elevator hoistway as each other or each in its own elevator hoistway, the first wall of which elevator hoistways is marked with the reference number 23 and the second, the wall on the opposite side of the elevator hoistway, with the reference number 24. In this solution the first hoistway doors 1*a* of the first elevator car 1 are on the first wall 23 of the elevator hoistway and the second hoistway doors 1*c* are on the opposite, i.e. second, wall 24. Correspondingly the first hoistway doors 2*a* of the second elevator car 2 are on the first wall 23 of the elevator hoistway and the second hoistway doors 2*c* are on the opposite, i.e. second, wall 24.

It is obvious to the person skilled in the art that the invention is not limited solely to the examples described above, but that it may be varied within the scope of the claims presented below. Thus, for example, the compensation means can also be different and in different locations to what is presented above. In this case e.g. the pretensioning means presented in FIGS. 7 and 8 can be different to what is presented above.

Additionally, it is obvious to the person skilled in the art that the suspension arrangements of the elevator cars can be different to what is presented above.

The invention claimed is:

1. An elevator system comprising:

elevator cars including at least a first elevator car and a second elevator car, the first elevator car and the second elevator car connected via suspension ropes and a traction belt such that the first elevator car and the second elevator car configured to simultaneously move reciprocally in an elevator hoistway;

a hoisting machine including at least one traction sheave configured to move the traction belt; and compensators including a first pretensioning device and a second pretension device that are each secured to fixing points such that the traction belt extends from the first pretensioning device secured to a first one of the fixing points to a pair of diverting pulleys attached to a bottom of the first elevator car and around the at least one traction sheave onto a second pair of diverting pulleys attached to a bottom of the second elevator car, and terminates at the second pretensioning device secured to a second one of the fixing points, wherein each of the first pretension device and the second pretensioning device includes a roller, an adjustor, a spring and a u-shaped frame having a pair of side flanges between a base to form an interior of the frame, the interior of the frame houses the roller and the adjustor, the spring having a first end extending from the base in a direction perpendicular to a face of the base and a second end connected to the roller via a tensioning cable, and the adjustor configured to rotate along with the roller about an axis of rotation of a shaft of the roller and the adjustor that extends between fixing holes in the side flanges, the adjustor including an outer surface that is spirally eccentric with respect to the axis of rotation that corresponds to a spring constant of the spring such that the tensioning cable runs from the spring, about an eccentric spiral on the outer surface of the adjustor and attaches to adjuster, and the traction belt extends from the roller in a direction perpendicular to a direction of restoring force of the spring and onward towards one of the first elevator car and the second elevator car to maintain an alignment of the first elevator car at a sill of a first floor and the second elevator car at a sill of a second floor by applying a constant pre-tensioning force to the traction belt to compensate for positioning inaccuracies in each of the first elevator car and the second elevator car caused by loading of one or more of the elevator cars.

2. The elevator system of claim 1, wherein the compensator is attached to a first end and a second end of the traction belt.

3. The elevator system of claim 1, further comprising:

a traction device configured to move the elevator cars, the traction device including the traction belt moved by the at least one traction sheave, the traction belt being a toothed traction belt.

4. The elevator system of claim 3, wherein the pretensioning devices are configured to tighten the traction device when tension in the traction device decreases.

5. The elevator system of claim 4, wherein the pretensioning devices are configured to reduce the tension, if the tension in the traction device is larger than a value, the value being a value associated with a constant force provided by the spring.

6. The elevator system of claim 4, wherein the pretensioning devices are configured to maintain a magnitude of the constant pre-tensioning force during a run of the elevator cars.

7. The elevator system of claim 3, wherein the pretensioning devices are configured to produce a constant force.

8. The elevator system of claim 1, wherein the first elevator car and the second elevator car are side-by-side in a same position with respect to a first wall of the elevator hoistway, the first wall having therein hoistway doors of the first elevator car and the second elevator car.

9. The elevator system of claim 1, wherein the first elevator car and the second elevator car are side-by-side and turned 180° with respect to each other, and the elevator hoistway includes a first wall and a second wall, the first wall having therein hoistway doors of the first elevator car and the second wall having therein the hoistway doors of the second elevator car.

10. The elevator system of claim 1, wherein the first elevator car and the second elevator car are side-by-side with-in a same position with respect to a first wall and a second wall of the elevator hoistway, the first wall has therein first hoistway doors of the first elevator car and the second elevator car and the second wall has therein second hoistway doors of the first elevator car and the second elevator car such that the first elevator car and the second elevator car are through-type elevator cars.

11. An elevator system comprising:

a suspension rope and a traction belt connecting a first elevator car and a second elevator car; and compensators configured to maintain an alignment of the first elevator car at a sill of a first floor and the second elevator car at a sill of a second floor by compensating for differences in loads between the first elevator car and the second elevator car, the compensators including pretensioning devices, the compensators each being secured to fixing points such that the traction belt extends from a first one of the compensators secured to a first one of the fixing points to a pair of diverting pulleys attached to a bottom of the first elevator car and around at least one traction sheave onto a second pair of diverting pulleys attached to a bottom of the second elevator car, and terminates at a second one of the compensators secured to a second one of the fixing points, wherein each of the pretensioning devices include a roller, an adjustor, a spring and a u-shaped frame having a pair of side flanges between a base to form an interior of the frame, the interior of the frame houses the roller and the adjustor, the spring having a first end extending from the base in a direction perpendicular to a face of the base and a second end connected to the roller via a tensioning cable, and the adjustor configured to rotate along with the roller about an axis of rotation of a shaft of the roller and the adjustor that extends between fixing holes in the side flanges, the adjustor including an outer surface that is spirally eccentric with respect to the axis of rotation that corresponds to a spring constant of the spring such that the tensioning cable runs from the spring, about an eccentric spiral on the outer surface of the adjustor and attaches to adjuster, and the traction belt extends from the roller in a direction perpendicular to a direction of restoring force of the spring and onward towards one of the first elevator car and the second elevator car to provide a constant tensioning force in the traction belt irrespective of the loads in the first elevator car and the second elevator car.

12. The elevator system of claim 11, wherein the traction belt is a toothed traction belt.

13. The elevator system of claim 11, wherein the traction sheave is configured to drive the traction belt to move the first elevator car and the second elevator car.

* * * * *